US005427996A

United States Patent [19]

Motoda et al.

[11] Patent Number: 5,427,996

[45] Date of Patent: Jun. 27, 1995

[54] HEAT-SENSITIVE RECORDING SHEET

[75] Inventors: Makoto Motoda; Haruyoshi Funae; Takao Kosaka; Toru Nakazawa; Yasuko Kaneko, all of Tokyo, Japan

[73] Assignee: Mitsubishi Paper Mills Limited, Japan

[21] Appl. No.: 117,769

[22] Filed: Sep. 8, 1993

[30] Foreign Application Priority Data

Sep. 9, 1992 [JP] Japan ..... 4-240730
Dec. 4, 1992 [JP] Japan ..... 4-325166

[51] Int. Cl.[6] ..... B41M 5/40

[52] U.S. Cl. ..... 503/200; 427/152; 503/226

[58] Field of Search ..... 427/152; 503/200, 209, 503/216, 226

[56] References Cited

FOREIGN PATENT DOCUMENTS

| | | | |
|---|---|---|---|
| 0436390 | 7/1991 | European Pat. Off. | 503/226 |
| 61-29584 | 2/1986 | Japan | 503/226 |
| 1029584 | 2/1986 | Japan | 503/226 |
| 61-54979 | 3/1986 | Japan | 503/226 |
| 2173284 | 7/1987 | Japan | 503/226 |
| 2-72993 | 3/1990 | Japan | 503/226 |
| 5-69665 | 3/1993 | Japan | 503/226 |

OTHER PUBLICATIONS

Verified Partial English Translation of JP-A-6-2-173284 (Fuji Photo Film Co Ltd) 30 Jul. 1987, p. 2, left lower column, lines 9-18.

Patent Abstracts of Japan, vol. 9, No. 111 (M-379) (1834) 15 May 1985 & JP-A-59 232 893 (RICOH KK) 27 Dec. 1984.

Patent Abstracts of Japan, vol. 12, No. 14 (M-659) (2861) 16 Jan. 1988 & JP-A-62 173 284 (Fuji Poto Film Co Ltd) 30 Jul. 1987.

Patent Abstracts of Japan, vol. 4, No. 139 (M-034) 19 Jul. 1980 & JP-A-55 095 593 (Honshu Paper Co Ltd) 19 Jul. 1980.

Patent Abstracts of Japan, vol. 11, No. 228 (M-610) 24 Jul. 1987 & JP-A-62 042 884 (Fuji Poto Film Co Ltd) 24 Feb. 1987.

Patent Abstracts of Japan, vol. 7, No. 55 (M-198) (1200) 5 Mar. 1983 & JP-A-57 201 692 (Fuji Shashin Film KK) 10 Dec. 1982.

*Primary Examiner*—B. Hamilton Hess
*Attorney, Agent, or Firm*—Cushman Darby & Cushman

[57] ABSTRACT

A heat-sensitive recording sheet superior in color formation and sticking resistance and excellent in storage stabilities such as plasticizer resistance and wet-rub resistance and printability which comprises a support and, provided thereon, a heat-sensitive recording layer and a protective layer is provided by using as a main component of the protective layer in the case of the protective layer comprising one layer a latex having a softening point of 200°-350° C. obtained by polymerizing mainly a specific hydrophobic vinyl monomer in the presence of a polymeric latex having a glass transition temperature of 50° C. or lower and as a main component of the protective layer in the case of the protective layer comprising two or more layers a latex having a softening point of 150°-260° C. in the inner layer(s) and preferably, using in the outermost protective layer said specific latex having a softening point of 200°-350° C. used in the protective layer comprising one layer. Furthermore, the heat-sensitive recording layer may optionally contain 2,4'-dihydroxydiphenyl sulfone and preferably a hindered phenol.

10 Claims, No Drawings

HEAT-SENSITIVE RECORDING SHEET

BACKGROUND OF THE INVENTION

1. Field of the Invention

The present invention relates to a heat-sensitive recording sheet and more particularly, to a heat-sensitive recording sheet improved in color formability and sticking resistance and excellent in image stabilities such as plasticizer resistance and water resistance and in printability.

2. Related Art

Recently, heat-sensitive recording sheets which form a color by application of heat are widely used for facsimile, word processors, plotter systems, labeling and the like. This is because the printing system comprises forming color images by an instantaneous chemical reaction with heating and has the advantages such as use of small devices, high recording speed, little noise and environmental pollution, and low cost. However, in the case of customarily employed heat-sensitive recording systems which use dye precursors and electron-accepting compounds as color forming components, the white portions of the recording sheet sometimes develop color with organic solvents such as toluene and methyl ethyl ketone, and decoloration of the color formed portions sometimes occurs when the sheet comes to contact with a hair dressing, dibutyl phthalate or dioctyl phtahalate used as a plasticizer in a rubber eraser or synthetic resin film, or even when the sheet is wetted with water or the wetted portion is rubbed. Further problems are discoloration of the color formed portions or color formation of the white portions when letters, figures and the like are written with a maker or fluorescent marker, sticking of a thermal head to heat-sensitive recording layer of the sheet when it is printed, and incomplete color development due to piling on the thermal head surface. Furthermore, when the heat-sensitive recording sheet is applied for labels, tickets or forms processed by an automatic vendor or cash dispenser machine, printability of the heat-sensitive layer surface, e.g. sufficient surface strength, is required since that surface is usually printed by a press.

For improving the storage stability against organic solvents and chemicals, it has been proposed to use a bisphenolsulfone compound in place of a conventional electron-accepting compound or to use an another color forming system that makes use of an aromatic isocyanate and an imino compounds in combination (Japanese Patent Application Kokai Nos. 58-38733 and 58-104959). 2,4'-dihydroxydiphenyl sulfone (Japanese Patent Application Kokai No. 63-39991), which proved to provides particularly excellent image preservation stability, but failed to provide sufficient water resistance. Said Japanese Patent Application Kokai Nos. 58-38733 and 58-104959 showed a promise in providing both the image preservation stability and water resistance, but failed to retain records when they are wet and rubbed.

Furthermore, there have been made various proposals to solve the above defects by providing a protective layer mainly composed of water-soluble polymers, water-dispersible polymers or the like on the heat-sensitive recording layer (Japanese Patent Application Kokai Nos.55-95593, 57-188392, 58-122892, 59-1797, 59-45191, 60-115484 and 62-42884). However, even when such protective layer of water-soluble polymer or the like is provided, no sufficient chemical resistance can be obtained unless the protective layer is provided in an appreciable amount, which in turn blocks thermal color development and the resulting records tend to be poor in legibility. As the protective layer is hydrophilic, water or wet-rub resistance is not sufficient even though chemical resistance can be improved; moreover, printability is not satisfactory and thermal color developing performance on that layer tends to be poor after printing.

When heat-sensitive recording sheets having such protective layer is put on an offset or other press, picking occurs unless the layer has a sufficient surface strength characteristics, and the picking triggers blanket piling to lower workability and efficiency.

SUMMARY OF THE INVENTION

The object of the present invention is to provide a heat-sensitive recording sheet which is superior in color formation and excellent in image stabilities such as plasticizer resistance, chemical resistance and water resistance and is free from problems in printing and in thermal color formation.

As a result of intensive research conducted by the inventors in an attempt to solve the above-mentioned problems, it has been found that a heat-sensitive recording sheet which is improved in chemical resistance, is superior in color formation and printability, and is suitable for labels can be obtained by providing one or two or more protective layers using, as materials for the respective layers, specific core-shell type latexes which differ in the range of softening point. The core-shell type latexes can be obtained by polymerizing a hydrophobic vinyl monomer around an aqueous dispersion of a polymer having a glass transition temperature (Tg) of 50° C. or lower, namely, a latex which is used as a core. It is preferred that when only one protective layer is provided, a core-shell latex having a softening point of 200°–350° C. (hereinafter referred to as "latex X") is used as a main component, and when two or more protective layers are provided, a core-shell latex having a softening point of 150°–260° C. (hereinafter referred to as "latex Y") is used as a main component of the inner layer(s) and latex X or a polymer latex having a softening point of 200°–350° C. is used for the outermost layer.

While reasons why the above-mentioned advantageous effects of the present invention can be obtained have yet to be clarified, it is supposed that in the latex X and the latex Y, the relatively soft polymer of the core and the relatively hard polymer of the shell form a composition and when the softening point of the composition is within a specific range, the core has the effect to improve chemical resistance, plasticizer resistance, bonding strength and water resistance and the shell has the effect to improve sticking resistance as well as chemical resistance and plasticizer resistance. It can be further considered that allotment of the latexes or the polymer having the specific range of softening point to the outermost layer and the inner layer(s) helps bring the respective functional properties of their components into a favorable balance.

That is, when the softening point of the polymer used in the outermost protective layer is low, sticking of a thermal head occurs at the time of color formation and when it is too high, bonding strength goes down leading to poor printability. In the case of only one protective layer, the latex X having a softening point of 200°–350° C. can be used as a main component. In the case of two or more protective layers, the latex Y having a softening point of 150°-260° C. is used as a main component of the inner layer(s) and the latex X or a polymer latex having a softening point of 200°-350° C. is used as a main component of the outermost layer, whereby plasticizer resistance and chemical resistance can be improved.

When two or more protective layers are provided, the latex having a lower softening point can be employed in the inner layer(s), because its influence on the thermal head sticking is small and bonding strength is raised as well. However, if the softening point goes down to lower than 150° C. thermal head sticking performance goes down; if it goes up higher than 260° C. printability comes to be affected harmfully due probably to worsened affinity with neighboring layers.

The term "Tg" used herein means a temperature at which a material changes from a glass-like solid state to a rubber-like state and this is measured by change of temperature in specific heat or change of temperature in specific volume and specific heat and specific volume rapidly change at the transition temperature. Differential thermal analysis (DTA method) or differential scanning calorimetry (DCS method) is utilized for measurement. The softening point is a temperature at which a substance begins to deform and soften upon heating and measured by DTA method or DSC method as in the measurement of Tg.

If there are a plurality of peaks in the softening point measured by DTA method or DSC method, the highest temperature which is the softening point of the shell portion of polymer which has a great influence on the sticking properties is employed.

Example of Tg of the polymers is explained as a glass transition point of polymer materials in "Handbook of Polymer Materials (Kobunshi Zairyo Binran)" (edited by Polymer Society) and as Tg in "Encyclopedia of Chemistry (Kagaku Daijiten)" (edited by Editorial Committee for Encyclopedia of Chemistry).

In the case of using a colorless or palely colored dye precursor and an acidic material as a color former in the heat-sensitive recording layer, if 2,4'-dihydroxydiphenyl sulfone is used as the acidic material and the above-mentioned core-shell type latex is used in the protective layer, a heat-sensitive recording sheet is obtained which is superior in printability and excellent in sensitivity and storage stability than when other acidic materials (such as bisphenol A) widely used for facsimile are used. This is supposedly because the affinity between the heat-sensitive recording layer containing 2,4'-dihydroxydiphenyl sulfone and the protective layer is superior, but when amount of the binder for the heat-sensitive recording layer is increased for further improving the printability, color developing sensitivity deteriorates.

DETAILED DESCRIPTION OF PREFERRED EMBODIMENTS

As polymer latexes used for the core of the latex X and latex Y in the present invention, there may be used those which are known or polymerized by known processes and there are no special limitations as far as they have a Tg of 50° C. or lower. Examples of such polymer latexes are styrene-butadiene copolymer, methyl methacrylate-butadiene copolymer, methyl methacrylate-styrene-butadiene copolymer, acrylonitrile-butadiene copolymer, styrene polymer, isoprene polymer, butadiene polymer, vinyl acetate-acrylate ester copolymer, acrylate ester polymer, vinyl acetate-ethylene copolymer, vinyl chloride polymer, vinylidene chloride polymer and derivatives of these polymers which have a Tg of 50° C. or lower. If the Tg of them is higher than 50° C., heat color formability is inferior and furthermore printability is also deteriorated. The lower limit of Tg usable is restricted by the lower limit of the softening point of the resulting core-shell latex X or Y, but it is generally about −30° C.

The hydrophobic vinyl monomers used for forming the shell of the latex X and latex Y are those which produce hydrophobic polymers upon polymerization. Examples of them are aromatic vinyl compounds such as styrene and methylstyrene, methacrylate esters such as methyl methacrylate, ethyl methacrylate and isopropyl methacrylate, nitrile compounds such as acrylonitrile and methacrylonitrile, acrylic compounds such as p-carbomethoxyphenyl acrylate, 2,4-dichlorophenyl acrylate and glycidyl methacrylate methylolacrylamide, and vinyl chloride which produce polymers having a glass transition temperature of 55° C. or higher upon polymerization. The upper limit of the glass transition temperature is restricted by the upper limit of the softening point of the resulting latex X or Y in the present invention.

In order to improve dispersion of the latex X or Y of the present invention in water, or to improve plasticizer resistance of the protective layer(s), hydrophlic monomers may be optionally employed. As such hydrophilic monomers, mention may be made of, for example, acrylamide, methacrylamide, acrylic acid, methacrylic acid, dimethylaminoethyl methacrylate and dimethylaminopropylmethacrylamide. These monomers may have been copolymerized with the core polymers beforehand, or used as monomer components and with the hydrophobic monomers together in forming the shell.

The latex X or Y of the present invention can be obtained by conventional polymerization processes such as, for example, radical polymerization using peroxides such as ammonium persulfate and potassium persulfate and redox processes using peroxides in combination with reducing agents such as sodium thiosulfate.

When the protective layer of the heat-sensitive recording sheet comprises two or more layers, a water-soluble polymer or polymer latex having a softening point of 200°-350° C. is used in the outermost layer as a main component.

In the respective layers of the protective layer, there may be used a conventionally employed water-soluble polymer or polymer latex in addition to the latex X in such an amount as not impairing the effects of the present invention, preferably about 30% by weight almost based on the total weight of the protective layers. As examples of such polymer there may be used polyvinyl alcohol, carboxymethylcellulose, methylcellulose, ethylcellulose, hydroxymethylcellulose, polyacrylamide, starch, dextrin, gelatin, casein, sodium alginate, polyvinyl pyrrolidone, sodium polyacrylate, polyethylene oxide and the like and derivatives thereof; as examples of such polymer latex, there may be used the polymer latexes used in the core of the latex X or Y of the present invention. The protective layer may further contain other additives, for example, inorganic pigments such as kaolin, calcined kaolin, aluminum silicate, aluminum hydroxide, calcium carbonate, silicon oxide, talc, magnesium carbonate and titanium oxide, organic pigments such as polystyrene, urea-formaldehyde resin and polyacrylic compounds, crosslinking agents such as dialdehyde type, epoxy type, polyamine type, diglycidyl type, dimethylolurea, ferric chloride, zirconium carbonate and ammonium chloride, metallic salts of higher fatty acids such as zinc stearate and waxes such as paraffin and polyethylene for improving sticking resistance, deforming agents, surfactants and the like.

The coating amount of the protective layer is adjusted to such an extent that little influence is exerted on the color development of the heat-sensitive layer. The coating amount is generally about 1–10 g/m$^2$ as solid, preferably 1–6 g/m$^2$ in one, two or more layers.

The colorless or palely colored dye precursors, the acidic materials, the aromatic isocyanate compounds, the imino compounds and the binders used in the heat-sensitive recording layer of the present invention may be ones known in the art and customarily used.

Examples of the dye precursors are crystal violet lactone, 3-indolino-3-p-dimethylaminophenyl-6-dimethylaminophthalide, 3-diethylamino-7-chlorofluoran, 3-diethylamino-7-cyclohexylaminofluoran, 3-diethylamino-5-methyl-7-t-butylfluoran, 3-diethylamino-6-methyl-7-anilinofluoran, 3-diethylamino-6-methyl-7-p-butylanilinofluoran, 2-(N-phenyl-N-ethyl)aminofluoran, 3-diethylamino-7-dibenzylaminofluoran, 3-cyclohexylamino-6-chlorofluoran, 3-diethylamino-6-methyl-7-xylidinofluoran, 2-anilino-3-methyl-6-(N-ethyl-p-toluidino)fluoran, 3-pyrrolidino-6-methyl-7-anilinofluoran, 3-pyrrolidino-7-cyclohexylaminofluoran, 3-piperidino-6-methyl-7-toluidinofluoran, 3-piperidino-6-methyl-7-anilinofluoran, 3-(N-methylcyclohexylamino-6-methyl-7-anilino)fluoran, 3-diethylamino-6-methyl-7-chlorofluoran and 3-dibutylamino-6-methyl-7-anilinofluoran.

Examples of the acidic materials are 4,4'-isopropylidenediphenol, 4,4'-isopropylidenebis(2-chlorophenol), 4,4'-isopropylidenebis(2-tert-butylphenol), 4,4'-sec-butylidenediphenol, 4,4'-(1-methyl-n-hexylidene)diphenol, 4-phenylphenol, 4-hydroxydiphenol, methyl 4-hydroxybenzoate, phenyl 4-hydroxybenzoate, 4-hydroxyacetophenone, salicylic acid anilide, 4,4'-cyclohexylidenediphenol, 4,4'-cyclohexylidenebis(2-methylphenol), 4,4'-benzylidenediphenol, 4,4'-thiobis(6-tert-butyl-3-methylphenol), 4,4'-isopropylidenebis(2-methylphenol), 4,4'-ethylenebis(2-methylphenol); 4,4'-cyclohexylidenebis-(2-isopropylphenol), 2,2'-dihydroxydiphenyl, 2,2'-methylenebis(4-chlorophenol), 2,2'-methylenebis-(4-methyl-6-t-butylphenol), 1,1'-bis(4-hydroxyphenol)cyclohexane, 2,2'-bis(4'-hydroxyphenyl)propane, novolak type phenolic resin, halogenated novolak type phenolic resin, α-naphthol, β-naphthol, 3,5-di-t-butylsalicylic acid, 3,5-di-α-methylbenzylsalicylic acid, 3-methyl-5-t-butylsalicylic acid, phthalic acid monoanilide, p-ethoxybenzoic acid, bis(4-hydroxyphenyl) sulfone, 4-hydroxy-4'-isopropyloxydiphenyl sulfone, di-(3-allyl-4-hydroxyphenyl) sulfone, p-benzyloxybenzoic acid and benzyl p-hydroxybenzoate.

Examples of the aromatic isocyanate compounds are 2,6-dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, diphenyl ether-4,4'-diisocyanate, naphthalene-1,4-diisocyanate, naphthalene-1,5-diisocyanate, naphthalene-1,3,7-triisocyanate, biphenyl-2,4,4'-triisocyanate, 4,4',4''-triisocyanato-2,5-dimethoxytriphenylamine and p-dimethylaminophenyl isocyanate. These isocyanate groups may be used in the form of so-called blocked isocyanate, namely, addition compounds with phenols, lactams, oximes or the like or in the form of diisocyanate, but when all of the isocyanate groups are blocked, the desired effects cannot be exhibited in some cases.

Examples of the imino compounds are 3-iminoindolin-1-one, 3-imino-4,5,6,7-tetrachloro-isoindolin-1-one, 3-imino-4,5,6,7-tetrabromoindolin-1-one, 3-imino-4,5,6,7-tetrafluoroisoindolin-1-one, 3-imino-5,6-dichloroisoindolin-1-one, 3-imino-4,5,7-trichloro-6-methoxy-isoindolin-1-one, 1-ethoxy-3-iminoisoindoline, 1,3-diiminoisoindoline, 1,3-diimino-4,5,6,7-tetrachloroindoline, 1,3-diimino-6-methoxyisoindoline, 1,3-diimino-6-cyanoisoindoline, 1,3-diimino-4,7-dithiazolyl-5,5,6,6-tetrahydroisoindoline, 1-iminonaphthalic acid imide, 1-iminodiphenic acid imide, 1-(5',6'-dichlorobenzothiazolyl-2'-imino)-3-iminoisoindoline, 1-(6'-methylbenzothiazolyl-2'-imino)-3-iminoisoindoline, 3-imino-1-sulfobenzoic acid imide, 3-imino-1-sulfo-6-chlorobenzoic acid imide, 3-imino-1-sulfo-5-bromonaphthoic acid imide and 3-imino-2-methyl-4,5,6,7-tetrachloroisoindolin-1-one.

Examples of the binders are starches such as oxidized starch, phosphoric acid esterified starch and etherified starch, water-soluble binders such as hydroxyethylcellulose, methylenecellulose, polyvinyl alcohol, styrene-acryl resin, polyacrylamide, carboxymethylcellulose, gum arabic and casein and derivatives thereof, and latexes such as styrene-butadiene latex.

When 2,4-dihydroxydiphenyl sulfone is used, care should be taken that the amount of the binder is not too large.

Amount of the binder is suitably about 5–35% by weight based on the total solid content of the heat-sensitive recording layer and if it is more than 40% by weight, color sensitivity greatly decreases.

Furthermore, when 2,4-dihydroxydiphenyl sulfone is used, image stability can be further improved by containing in the heat-sensitive recording layer a hindered phenol, especially 1,1,3-tris-(2-methyl-4-hydroxyphenyl)butane.

Amount of the hindered phenol in the present invention is suitably about 1–30% by weight based on the total solid content of the heat-sensitive recording layer.

Examples of the hindered phenols are 1,1,3-tris-(2-methyl-4-hydroxy-5-cyclohexylphenyl)butane, 1,1,3-tris-(2-methyl-4-hydroxy-5-tert-butylphenyl)butane, 1,1,3-tris-(2-ethyl-4-hydroxy-5-tertbutylphenyl)butane, 1,1,3-tris-(2-methyl-hydroxy-5-tertbutylphenyl)propane and pentaerythrityl-tetrakis[3-(3,5-di-tert-butyl-4-hydroxyphenyl)propionate].

Examples of the pigments used in the heat-sensitive recording layer are diatomaceous earth, talc, kaolin, calcined kaolin, calcium carbonate, magnesium carbonate, titanium oxide, zinc oxide, silicon oxide, aluminum hydroxide and urea-formaldehyde resin. As other additives, there may be used metallic salts of higher fatty acids such as zinc stearate and calcium stearate, waxes such as paraffin, oxidized paraffin, polyethylene and polyethylene oxide, wetting agents such as dioctyl sulfosuccinate, ultraviolet absorbers such as of benzophenone and benzotriazole types, surface active agents, fluorescent dyes and the like.

When an intermediate layer is provided between a support and the heat-sensitive recording layer for improvement of color developing intensity and the like, the inorganic or organic pigments, hollow organic pigments and binders used for the heat-sensitive recording layer are used for the intermediate layer. Furthermore, dispersants for pigments, viscosity modifiers, defoaming agents and the like may optionally be used.

The preferred support used in the present invention is paper, but there may be used synthetic papers, metallic foils, polyolefin-laminated paper or the like, films such as polyethylene terephthalate alone or in combination of them as composite sheets. Air knife coaters, gravure coaters, roll coaters, rod coaters, curtain coaters, die coaters, lip coaters, blade coaters and the like are used for coating of the intermediate layer, heat-sensitive recording layer and protective layer. When the intermediate layer is provided under the heat-sensitive recording layer, there may also be used a size press, a gate roll coater and the like which are used in paper making process. For coating the protective layer, printing methods such as offset printing and silk screen printing may also be used. Moreover, machine calender, super calender, gloss calender, brushing and the like are utilized for improving surface smoothness of the coated layer.

The present invention is explained in more detail by the following nonlimiting examples. All parts and % are by weight.

EXAMPLE 1

Preparation of coating color for heat-sensitive recording layer:

| | |
|---|---|
| Solution (A) | |
| 3-Dibutylamino-6-methyl-7-anilinofluoran (solid content) | 12 parts |
| 10% Aqueous polyvinyl alcohol solution (NM 11 manufactured by Nippon Gosei Kagaku Co.) (solid content 1.8 part) | 18 parts |
| Water | 30 parts |
| Solution (B) | |
| 4,4'-Isopropylidenediphenol (solid content) | 40 parts |
| p-Benzylbiphenyl (solid content) | 40 parts |
| Zinc stearate (solid content) | 20 parts |
| 10% Aqueous polyvinyl alcohol solution (NM 11) (solid content 5 parts) | 50 parts |
| Water | 100 parts |

The solution (A) and the solution (B) were separately dispersed by a sand grinder until a volumetric average particle size measured by laser diffraction method reached about 1.5 μm and a coating color of the following composition was prepared.

| | |
|---|---|
| Calcium carbonate (Brt 15 manufactured by Shiraishi Kogyo Co.) (solid content) | 8 parts |
| Solution (B) | 30 parts |
| 10% Aqueous polyvinyl alcohol solution (NM 11) | 40 parts |
| Solution (A) | 12 parts |
| Water | 100 parts |

Preparation of coating solution (C) for protective layer:

Methyl methacrylate and acrylonitrile as a shell were polymerized by a conventional process in the presence of methyl methacrylate-acrylic acid-styrene-butadiene polymer latex (having a glass transition temperature of 5° C.) as a core to obtain a latex X (synthesis product L) having a softening point of 235° C. Using the resulting latex, a coating solution (C) for protective layer having the following composition was prepared.

| | |
|---|---|
| 20% latex X (synthesis product L) | 100 parts |
| Calcium carbonate (Brt 15) (solid content) | 2 parts |
| 20% Zinc stearate dispersion | 2 parts |
| Epoxy crosslinking agent (solid content 20%) | 2 parts |
| Water | 50 parts |

The coating color for heat-sensitive recording layer was coated at a coating amount of 6 g/m$^2$ (solid content) on one side of a paper having a basis weight of 60 g/m$^2$ and dried. Then, the coating solution (C) for protective layer was coated thereon at a coating amount of 3 g/m$^2$ (solid content) and dried. Thereafter, the coated paper was subjected to super calender treatment to obtain a heat-sensitive recording sheet of the present invention.

EXAMPLE 2

Preparation of coating solution (D) for protective layer:

Methyl methacrylate and methyl acrylate as a shell were polymerized by a conventional process in the presence of methyl methacrylate-acrylonitrile-butadiene-acrylamide polymer latex (having a glass transition temperature of 16° C.) as a core to obtain a latex Y (synthesis product M) having a softening point of 170° C. Using the resulting polymer, a coating solution (D) for protective layer having the following composition was prepared.

| | |
|---|---|
| 20% Aqueous dispersion of latex Y (synthesis product M) | 100 parts |
| Epoxy crosslinking agent (solid content 20%) | 2 parts |
| Calcium carbonate (Brt 15) (solid content) | 2 parts |
| Water | 50 parts |

In the same manner as in Example 1, the coating color for heat-sensitive recording layer was coated at a coating amount of 6 g/m$^2$ (solid content) and dried. Then, the coating solution (D) for protective layer was coated thereon at a coating amount of 2 g/m$^2$ (solid content) and dried. Thereafter, the coating solution (C) for protective layer was coated thereon at a coating amount of 1 g/m$^2$ (solid content) and dried. Thereafter, the coated paper was subjected to super calender treatment to obtain a heat-sensitive recording sheet of the present invention.

EXAMPLE 3

A heat-sensitive recording sheet of the present invention was obtained in the same manner as in Example 1 except that the following coating solution (E) for protective layer was used in place of the coating solution (C).

Preparation of coating solution (E) for protective layer:

Acrylonitrile as a shell was polymerized by a conventional process in the presence of acrylonitrile-acrylic acid-styrene-butadiene polymer latex (having a glass transition temperature of 38° C.) as a core to obtain a latex X (synthesis product N) having a softening point of 315° C. Using the resulting polymer, a coating solution (E) for protective layer having the following composition was prepared.

| | |
|---|---|
| 20% Aqueous dispersion of latex X (synthesis product N) | 100 parts |
| Calcium carbonate (Brt 15) (solid content) | 2 parts |
| 20% Zinc stearate dispersion | 2 parts |
| Water | 50 parts |

EXAMPLE 4

A heat-sensitive recording sheet was obtained in the same manner as in Example 2 except that the latex X (synthesis product L) was used in place of the latex Y (synthesis product M) used in the coating solution (D) for protective layer.

EXAMPLE 5

A heat-sensitive recording sheet was obtained in the same manner as in Example 2 except that polyvinyl alcohol (softening point: 230° C.) was used in place of the latex X (synthesis product L) in preparation of the coating solution (C) for the outermost protective layer.

EXAMPLE 6

A heat-sensitive recording sheet was obtained in the same manner as in Example 2 except that the latex X (synthesis product N) was used in place of the latex X (synthesis product L) in preparation of the coating solution (C) for the uppermost protective layer.

COMPARATIVE EXAMPLE 1

A heat-sensitive recording sheet was obtained in the same manner as in Example 1 except that the latex Y (synthesis product M) was used in place of the latex X (synthesis product L) used in the coating solution (C) for protective layer.

COMPARATIVE EXAMPLE 2

A heat-sensitive recording sheet was obtained in the same manner as in Example 1 except that in place of the latex X (synthesis product L) in preparation of the protective layer (C), was used a core-sheet latex Z (synthesis product O) (softening point: 245° C.) obtained by using methyl methacrylate-styrene-acrylic acid polymer latex (glass transition temperature: 70° C.) in place of the polymer latex (glass transition temperature: 10° C.) used in production of the latex X (synthesis product L). The above core-sheet latex Z, as well as the same that appears in the later examples, is outside the scope of the present invention.

COMPARATIVE EXAMPLE 3

A heat-sensitive recording sheet was obtained in the same manner as in Example 2 except that the core-sheet latex Z (synthesis product O) was used in place of the latex Y (synthesis product M) used in the preparation of the coating solution (D) for protective layer.

COMPARATIVE EXAMPLE 4

A heat-sensitive recording sheet was obtained in the same manner as in Example 2 except that in place of the latex Y (synthesis product M) in preparation of the protective layer (D), was used a core-shell latex Z (synthesis product P) (softening point: 125° C.) obtained by using methyl acrylate, methyl methacrylate and butadiene in place of methyl acrylate and methyl methacrylate as the vinyl monomers used in production of the latex Y (synthesis product M).

COMPARATIVE EXAMPLE 5

A heat-sensitive recording sheet was obtained in the same manner as in Example 2 except that a core-shell latex Z (synthesis product Q) (softening point: 290° C.) obtained by polymerizing acrylonitrile and methyl methacrylate in the presence of acrylonitrile-acrylic acid-styrene-butadiene polymer latex (glass transition temperature: 38° C.) as a core was used in place of the latex Y (synthesis product M) in preparation of the protective layer (D).

COMPARATIVE EXAMPLE 6

A heat-sensitive recording sheet was obtained in the same manner as in Example 1 except that polyvinyl alcohol (softening point: 230° C.) was used in place of the latex X (synthesis product L) used in the coating solution (C) for protective layer.

COMPARATIVE EXAMPLE 7

A heat-sensitive recording sheet was obtained in the same manner as in Example 5 except that polyvinyl alcohol (softening point: 210° C.) was used in place of the latex Y (synthesis product M) used in the coating solution (D) for protective layer.

The heat-sensitive recording sheets obtained in the above Examples 1–6 and Comparative Examples 1–5 were evaluated by the following methods and the results are shown in Table 1. The glass transition temperature and the softening point were measured by differential thermal analysis and differential scanning calorimetry. The unit employed in the Table is "° C.". Thermal color development intensity Each of the thus prepared specimen sheets was put through a thermal color development tester manufactured by Ohkura Denki KK, where an area of a solid pattern was printed using a thermal head having resistance of 2,800 ohm of which pulse duration was set 1.2 msec. The color development intensity was measured by a Macbeth reflective densitometer. The larger numerical value means the larger color development intensity.

Sticking resistance:

This was evaluated by the noise at the time of the aforesaid thermal color development intensity test and by degree of void of the color and/or degree of shrinkage in that solid pattern area. Results of the evaluation was graded by the following criteria.

"O": No sticking observed.

" Δ": Some sticking observed, but this was acceptable.

" Δ": Some sticking observed, but this was acceptable.

"x": Considerable sticking observed and this was unacceptable.

Plasticizer resistance:

Three wrapping films were superposed on the surface of the thermal color developed sheet and these were left to stand under load for 24 hours at 50° C. and 90% RH. After the treatment, the color formed portion was visually evaluated and the plasticizer resistance was graded by the following criteria.

" ": No change observed before and after the treatment.

" ": Some change observed after the treatment.

"x": Great change observed after the treatment.

Wet-rub resistance:

A specimen sheet having a color developed portion was dipped in pure water bath for 3 minutes, then both of the color formed and white portions were rubbed five times with a finger in the bath. The specimen sheet was taken out of the bath and dried, then a part of that wet-rubbed white portion was heated to develop color. Reduction in color density on that color formed and wet-rubbed portion, and color developing capability on that wet-rubbed white portion were evaluated and graded the following criteria;

"○": Substantially no reduction in color density observed, and/or color developing capability preserved.

"Δ": Certain reduction in color density observed, and/or color developing capability some what affected, but practically acceptable.

"x": Appreciable reduction in color density observed, and/or color developing capability deteriorated; practically unacceptable.

Printability:

The specimen sheet was printed by an RI printability tester (manufactured by Akira Mfg. KK) using an offset printing ink, and the printability was evaluated in terms of degree of picking of the coated layers and graded by the following criteria;

" ": No picking observed.

" ": Tendency to pick was observable.

"x": Picking observed.

TABLE 1

| | Softening point of polymer | | Heat color | Sticking | Withstandability | | |
|---|---|---|---|---|---|---|---|
| | Inner layer | Outermost layer | form-ability | resist-ance | Plastic-izer | Wet rub | Print-ability |
| Examples | | | | | | | |
| 1 | — | 235 | 1.20 | ○ | Δ | Δ | Δ |
| 2 | 170 | 235 | 1.14 | ○ | ○ | ○ | ○ |
| 3 | — | 315 | 1.22 | ○ | Δ | Δ | Δ |
| 4 | 235 | 235 | 1.66 | ○ | ○ | ○ | Δ |
| 5 | 170 | 230 | 1.15 | Δ | ○ | Δ | ○ |
| 6 | 170 | 315 | 1.17 | ○ | ○ | ○ | ○ |
| Comparative Examples | | | | | | | |
| 1 | — | 170 | 1.19 | x | Δ | ○ | ○ |
| 2 | — | 245 | 1.06 | ○ | x | x | x |
| 3 | 245 | 235 | 1.11 | ○ | Δ | x | Δ |
| 4 | 125 | 235 | 1.07 | x | x | ○ | ○ |
| 5 | 290 | 235 | 1.15 | ○ | Δ | x | Δ |
| 6 | — | 230 | 1.16 | Δ | Δ | x | Δ |
| | 210 | 230 | 1.18 | Δ | ○ | x | Δ |

In the following Examples, 2,4'-dihydroxydiphenyl sulfone was used in the heat-sensitive recording layer.

EXAMPLE 7

Preparation of coating color for heat-sensitive recording layer:

| | |
|---|---|
| Solution (A) | |
| 3-Dibutylamino-6-methyl-7-anilinofluoran (solid content) | 12 parts |
| 10% Aqueous polyvinyl alcohol solution (NM 11 manufactured by Nippon Gosei Kagaku Co.) (solid content 1.8 part) | 18 parts |
| Water | 30 parts |
| Solution (B) | |
| 2,4'-Dihydroxydiphenyl sulfone (solid content) | 40 parts |

-continued

| | |
|---|---|
| p-Benzylbiphenyl (solid content) | 40 parts |
| 1,1,3-tris-(2-methyl-4-hydroxy-5-cyclohexyl-phenyl)butane (solid content) | 10 parts |
| Zinc stearate (solid content) | 20 parts |
| 10% Aqueous polyvinyl alcohol solution (NM 11) (solid content 5 parts) | 50 parts |
| Water | 100 parts |

The solution (A) and the solution (B) were separately dispersed by a sand grinder until a volumetric average particle size measured by laser diffraction method reached about 1.5 μm and a coating color of the following composition was prepared.

| | |
|---|---|
| Calcium carbonate (Brt 15 manufactured by Shiraishi Kogyo Co.) (solid content) | 8 parts |
| Solution (B) | 30 parts |
| 10% Aqueous polyvinyl alcohol solution (NM 11) | 40 parts |
| Solution (A) | 12 parts |
| Water | 100 parts |

Preparation of coating solution (C) for protective layer:

Using the same latex X (synthesis product L) as in Example 1, a coating solution (C) for protective layer having the following composition was prepared.

| | |
|---|---|
| 20% latex X (synthesis product L) | 100 parts |
| Calcium carbonate (Brt 15) (solid content) | 2 parts |
| 20% Zinc stearate dispersion | 2 parts |
| Epoxy crosslinking agent (solid content 20%) | 2 parts |
| Water | 50 parts |

The coating color for heat-sensitive recording layer was coated at a coating amount of 6 g/m$^2$ (solid content) on one side of a paper having a basis weight of 60 g/m$^2$ and dried. Then, the coating solution (C) for protective layer was coated thereon at a coating amount sheet of the present invention. of 3 g/m$^2$ (solid content) and dried. Thereafter, the coated paper was subjected to super calender treatment to obtain a heat-sensitive recording sheet of the present invention.

EXAMPLE 8

Preparation of coating solution (D) for protective layer:

Using the same latex Y (synthesis product M) as in Example 2, a coating solution (D) for protective layer having the following composition was prepared.

| | |
|---|---|
| 20% Aqueous dispersion of latex Y (synthesis product M) | 100 parts |
| Epoxy crosslinking agent (solid content 20%) | 2 parts |
| Calcium carbonate (Brt 15) (solid content) | 2 parts |
| Water | 50 parts |

In the same manner as in Example 7, the coating color for heat-sensitive recording layer was coated at a coating amount of 6 g/m$^2$ (solid content) and dried. Then, the coating solution (D) for protective layer was coated thereon at a coating amount of 2 g/m$^2$ (solid content) and dried. Thereafter, the coating solution (C) for protective layer was coated thereon at a coating amount of 1 g/m$^2$ (solid content) and dried. Thereafter, the coated paper was subjected to super calender treatment to obtain a heat-sensitive recording

EXAMPLE 9

A heat-sensitive recording sheet of the present invention was obtained in the same manner as in Example 7 except that the following coating solution (E) for protective layer was used in place of the coating solution (C).

Preparation of coating solution (E) for protective layer:

Using the latex X (synthesis product N) used in Example 3, a coating solution (E) for protective layer having the following composition was prepared.

| | |
|---|---|
| 20% Aqueous dispersion of latex X (synthesis product N) | 100 parts |
| Calcium carbonate (Brt 15) (solid content) | 2 parts |
| 20% Zinc stearate dispersion | 2 parts |
| Water | 50 parts |

EXAMPLE 10

A heat-sensitive recording sheet was obtained in the same manner as in Example 8 except that the latex X (synthesis product L) was used in place of the latex Y (synthesis product M) used in the coating solution (D) for protective layer.

EXAMPLE 11

A heat-sensitive recording sheet was obtained in the same manner as in Example 8 except that polyvinyl alcohol (softening point: 230° C.) was used in place of the latex X (synthesis product L) in preparation of the coating solution (C) for the outermost protective layer.

EXAMPLE 12

A heat-sensitive recording sheet was obtained in the same manner as in Example 8 except that the latex X (synthesis product N) was used in place of the latex X (synthesis product L) in preparation of the coating solution (C) for the outermost protective layer.

EXAMPLE 13

A heat-sensitive recording sheet was obtained in the same manner as in Example 10 except that 1,1,3-tris-(2-methyl-4-hydroxy-5-cyclohexylphenyl)butane was not used in preparation of the coating color for the heat-sensitive recording layer.

COMPARATIVE EXAMPLE 8

A heat-sensitive recording sheet was obtained in the same manner as in Example 7 except that the latex Y (synthesis product M) was used in place of the latex X (synthesis product L) used in the coating solution (C) for protective layer.

COMPARATIVE EXAMPLE 9

A heat-sensitive recording sheet was obtained in the same manner as in Example 7 except that in place of the latex X (synthesis product L) in preparation of the protective layer (C), was used the latex Z (synthesis product 0) (softening point: 245° C.) obtained by using methyl methacrylate-styrene-acrylic acid polymer latex (glass transition temperature: 70° C.) in place of the polymer latex (glass transition temperature: 10° C.) used in production of the latex X (synthesis product L).

COMPARATIVE EXAMPLE 10

A heat-sensitive recording sheet was obtained in the same manner as in Example 8 except that the latex Z (synthesis product 0) was used in place of the latex Y (synthesis product M) used in preparation of the coating solution (D) for protective layer.

COMPARATIVE EXAMPLE 11

A heat-sensitive recording sheet was obtained in the same manner as in Example 8 except that in place of the latex Y (synthesis product M) in preparation of the coating solution (D) for protective layer, was used the latex Z (synthesis product P) (softening point: 125° C.) obtained by using methyl acrylate, methyl methacrylate and butadiene in place of methyl acrylate and methyl methacrylate as the vinyl monomers used in production of the latex Y (synthesis product M).

COMPARATIVE EXAMPLE 12

A heat-sensitive recording sheet was obtained in the same manner as in Example 8 except that the latex Z (synthesis product Q) (softening point: 290° C.) obtained by polymerizing acrylonitrile and methyl methacrylate in the presence of acrylonitrile-acrylic acid-styrene-butadiene polymer latex (glass transition temperature: 38° C.) was used in place of the latex Y (synthesis product M) in preparation of the coating solution (D) for protective layer.

COMPARATIVE EXAMPLE 13

A heat-sensitive recording sheet was obtained in the same manner as in Example 7 except that a modified polyvinyl alcohol (OTP-2, manufactured by Kuraray KK; softening point: 230° C.) was used in place of the latex X (synthesis product L) used in the coating solution (C) for protective layer.

COMPARATIVE EXAMPLE 14

A heat-sensitive recording sheet was obtained in the same manner as in Example 11 except that a modified polyvinyl alcohol containing silil group (softening point: 210° C.) was used in place of the latex Y (synthesis product M) used in the coating solution (D) for protective layer.

EXAMPLE 14

15 g of 1,3-dimino-4,5,6,7-tetrachloroisoindoline was ground in a ball mill together with 60 g of 1% aqueous polyvinyl alcohol solution for 24 hours, and separately, 10 g of 4,4',4''-triisocyanato-2,5-dimethoxyphenylamine was ground in a ball mill together with 40 g of 1% aqueous polyvinyl alcohol solution for 24 hours to obtain dispersions, respectively. Similarly, 0.4 g of 2-methoxy-5-N,N-diethylsulfamoylaniline was ground together with 20 g of 1% aqueous polyvinyl alcohol solution, and also similarly, 21 g of 4-hydroxymethylbiphenyl and 4 g of m-terphenyl were ground together with 125 g of 1% aqueous polyvinyl alcohol solution to obtain dispersions, respectively. The resulting four dispersions were mixed and thereto were added 125 g of a 40% aqueous dispersion of calcium carbonate and 50 g of a 30% aqueous dispersion of zinc stearate and additionally, 37 g of aqueous polyvinyl alcohol solution (NM-11 manufactured by Nippon Gosei Kagaku Co.) and 90 g of water. The mixture was sufficiently stirred to obtain a coating color. This was coated at a coating amount of 5.2 g/m$^2$ (solid content) on a base paper having a basis weight of 50 g/m$^2$ and dried and then, thereon was coated the coating solution (C) for protective layer at a coating amount of 3 g/m$^2$, dried and calendered in the same manner as in Example 1 to obtain a heat-sensitive recording sheet.

The resulting heat-sensitive recording sheet was evaluated to find that it was excellent in respective characteristics as shown in Table 2.

EXAMPLE 15

A heat-sensitive recording sheet was obtained in the same manner as in Example 8 except that di-(3-allyl-4-hydroxyphenyl) sulfone was used in place of 2,4'-dihydroxydiphenyl sulfone in preparation of the coating color for the heat-sensitive recording layer.

The heat-sensitive recording sheets obtained in the above Examples 7–15 and Comparative Examples 8–14 were evaluated in the same manner as in Examples 1–6 and Comparative Examples 1–7. The results are shown in Table 2.

TABLE 2

| | Softening point of polymer | | Heat color | Sticking | Withstandability | | |
|---|---|---|---|---|---|---|---|
| | Inner layer | Outermost layer | form-ability | resist-ance | Plastic-izer | Wet rub | Print-ability |
| Examples | | | | | | | |
| 7 | — | 235 | 1.31 | ○ | Δ | ○ | Δ~○ |
| 8 | 170 | 235 | 1.24 | ○ | ○ | ○ | ○ |
| 9 | — | 315 | 1.32 | ○ | Δ | ○ | Δ~○ |
| 10 | 235 | 235 | 1.26 | ○ | ○ | ○ | ○ |
| 11 | 170 | 230 | 1.25 | Δ | ○ | ○ | ○ |
| 12 | 170 | 315 | 1.27 | ○ | ○ | ○ | ○ |
| 13 | 235 | 235 | 1.25 | ○ | ○ | Δ | ○ |
| 14 | — | 235 | 1.13 | ○ | ○ | ○ | ○ |
| 15 | 170 | 235 | 1.20 | ○ | ○ | ○ | Δ |
| Comparative Examples | | | | | | | |
| 8 | — | 170 | 1.27 | x | Δ | ○ | ○ |
| 9 | — | 245 | 1.17 | ○ | x | ○ | x |
| 10 | 245 | 235 | 1.23 | ○ | Δ | ○ | x |
| 11 | 125 | 235 | 1.18 | x | x | ○ | ○ |
| 12 | 290 | 235 | 1.26 | ○ | Δ | ○ | x |
| 13 | — | 230 | 1.25 | x | Δ | ○ | x |
| 14 | 210 | 230 | 1.28 | Δ | ○ | ○ | x |

What is claimed is:

1. A heat-sensitive recording sheet which comprises a support, a heat-sensitive recording layer provided on the support and a protective layer provided on the surface of the heat-sensitive recording layer wherein said protective layer comprises one layer which is mainly composed of a latex X having a softening point of 200°–350° C. and obtained by polymerizing mainly at least one hydrophobic vinyl monomer having a glass transition temperature of 55° C. or higher in the presence of a polymer latex having a glass transition temperature of 50° C. or lower.

2. A heat-sensitive recording sheet according to claim 1, wherein the heat-sensitive recording layer additionally contains 2,4'-dihydroxydiphenyl sulfone.

3. A heat-sensitive recording sheet according to claim 2, wherein the heat-sensitive recording layer additionally contains a hindered phenol.

4. A heat-sensitive recording sheet according to claim 3, wherein the hindered phenol is 1,1,3-tris-(2-methyl-4-hydroxy-5-cyclohexylphenyl)butane.

5. A heat-sensitive recording sheet which comprises a support, a heat-sensitive recording layer provided on the support and a protective layer provided on the surface of the heat-sensitive recording layer wherein said protective layer comprises two or more layers, the inner protective layer being mainly composed of a latex Y having a softening point of 150°–260° C. and obtained by polymerizing mainly at least one hydrophobic vinyl monomer having a glass transition temperature of 55° C. or higher in the presence of a polymer latex having a glass transition temperature of 50° C. or lower and the outermost protective layer being mainly composed of a hydrophilic polymer or polymer latex having a softening point of 200°–350° C.

6. A heat-sensitive recording sheet according to claim 5, wherein the heat-sensitive recording layer additionally contains 2,4'-dihydroxydiphenyl sulfone.

7. A heat-sensitive recording sheet according to claim 4, wherein the outermost protective layer is mainly composed of a latex X having a softening point of 200°–350° C. and obtained by polymerizing mainly at least one hydrophobic vinyl monomer having a glass transition temperature of 55° C. or higher in the presence of a polymer latex having a glass transition temperature of 50° C. or lower.

8. A heat-sensitive recording sheet according to claim 5, wherein the outermost protective layer is mainly composed of a latex X having a softening point of 200°–350° C. and obtained by polymerizing mainly at least one hydrophobic vinyl monomer having a glass transition temperature of 55° C. or higher in the presence of a polymer latex having a glass transition temperature of 50° C. or lower.

9. A heat-sensitive recording sheet according to claim 8, wherein the heat-sensitive recording layer additionally contains a hindered phenol.

10. A heat-sensitive recording sheet according to claim 9, wherein the hindered phenol is 1,1,3-tris-(2-methyl-4-hydroxy-5-cyclohexylphenyl)butane.

* * * * *